US006042106A

United States Patent [19]

Kelly et al.

[11] Patent Number: 6,042,106

[45] Date of Patent: Mar. 28, 2000

[54] WET-PRINT CUT-SHEET MEDIA HANDLING SYSTEM

[75] Inventors: Kieran B Kelly; Larry A Jackson, both of Vancouver, Wash.

[73] Assignee: Hewlett-Packard Company, Palo Alto, Calif.

[21] Appl. No.: 09/141,645

[22] Filed: Aug. 27, 1998

[51] Int. Cl.[7] ..... B65H 29/70

[52] U.S. Cl. ..... 271/188; 271/192; 271/312

[58] Field of Search ..... 271/188, 189, 271/192, 209, 213, 214, 220, 307, 312, 313

[56] References Cited

U.S. PATENT DOCUMENTS 4,794,859 1/1989 Huseby et al. ..... 271/213 X
5,091,754 2/1992 Abe et al. ..... 271/188 X
5,603,493 2/1997 Kelly ..... 271/188

*Primary Examiner*—David H. Bollinger

[57] ABSTRACT

A sheet media handling system is provided for use in supporting a sheet ejected from a wet-ink hard copy apparatus output port while ink on a preceding sheet ink an output tray is allowed time to dry before depositing the succeeding on top thereof. The system employs a pair of guides having an elongate channel therebetween which receives a predetermined side edge of an ejected sheet. The channel bends the sheet in order to stiffen the sheet along its longitudinal axis such that only one edge need be supported. Once a trailing edge of an advancing sheet is ejected from the output port, a lower guide is retracted whereby the sheet falls under the force of gravity onto the output media stack in the output tray. Several advantageous lower guide upper surface constructs are disclosed. The advantages of the use of a guide mechanism on each side of the advancing output sheets is discussed.

31 Claims, 10 Drawing Sheets

WET-PRINT CUT-SHEET MEDIA HANDLING SYSTEM

BACKGROUND OF THE INVENTION

1. Field of the Invention

The present invention relates generally to hard copy apparatus and, more particularly, to a method and apparatus for handling wet-print, cut-sheet, media output in order to extend passive drying time before contact occurs between consecutively ejected sheets.

2. Description of Related Art

Because some hard copy apparatus use liquid inks, toners, and colorants (generically referred to hereinafter as "ink") and because output print media sheets—paper, envelopes, card stock, and the like (synonymously referred to hereinafter as "sheets" or "paper")—often are stacked immediately after printing, such wet systems have experienced difficulty with blotting and smearing of ink upon contact between consecutively deposited sheets in the output tray. For example, in a conventional ink-jet hard copy apparatus—such as a computer printer, a copier, a facsimile machine, or the like (synonymously referred to as a "printer" hereinafter)—sheet media are directed through a print cycle which includes picking up a sheet from an input tray, feeding it through the printer's printing station, and then ejecting it through an output port. Once ejected, the sheet usually is deposited in an output tray, consecutive sheets piling one on top of one another to form an output stack. The blotting and smearing problem has been particularly apparent where the ink drying time consistantly exceeds the time between printing of consecutive sheets. These detrimental effects are more pronounced in special print media, such as transparencies and glossy photographic quality papers where drying time is substantially longer than for plain paper.

Although a variety of solutions have been proposed for this problem, providing adequate ink drying time without some cost to the throughput efficiency, versatility, or paper size or composition limitations remains an issue for the system designer. Some printer manufacturers have attempted to eliminate ink smearing and blotting problems by decreasing the ink drying time. One solution has been to employ quick-drying ink. Another has been to employ special paper. Special inks and paper increase the cost of operation for the end-user and optimizing the dry-time factor may compromise other important parameters such as print quality or permanence. Yet another solution has been to provide a separate, active drying device adjacent the paper output path. Providing a separate drying device adds to the complexity and cost of the printer itself. A further solution has been to impose a delay on the deposit of each sheet into the stack to provide the previously printed sheet with adequate drying time. The most basic of such solutions have involved simply slowing printer throughput by creating an artificial time delay between the printing of consecutive sheets. This solution is contrary to the design goals of improving printer efficiency and throughput.

Still another solution has been to employ an ejection path passive drop scheme. A sheet emerging from the printer's output port is guided along the top of rails which suspend the sheet above the output tray. At the completion of printing and release of the trailing edge from the printing station or a downstream paper transport device, the sheet simply drops from the rails of its own weight. This gives the previously printed sheet further drying time. However, passive drop schemes are not always reliable due to cockling of sheets receiving dense print patterns. A cockled sheet may hang up on the rails and thus be pushed forward and out of the printer by the next sheet.

Another solution to the problem involved the use of an ejection path active drop mechanism where an output sheet is guided along the top of a pair of movable wings which temporarily support the sheet above the output tray. At the completion of printing and release of the trailing edge from the printing station or downstream paper transport device, the wings retract, allowing the sheet to fall. Again, the previously printed sheet is provided with extended dry time. Active wing mechanisms add complexity and cost to hard copy apparatus. Moreover, they are generally coupled to fixed pivot mechanisms and thus dictate the width of paper used in the printer. Another phenomenon associated with movable wing mechanism is "sheet sail," where the dropping sheet flies out of the paper as the wings are retracted.

U.S. Pat. No. 5,603,493 by Kieran Kelly (Feb. 18, 1997) for a System for Use in Handling Media teaches a sheet media handling system employing an edge guide mechanism providing a sheet stiffening bowing of an output sheet to hold the sheet above the output tray until released (assigned to the common assignee of the present invention and incorporated herein by reference). The present invention provides improvements on such mechanisms.

SUMMARY OF THE INVENTION

In its basic aspects, the present invention provides a print media handling apparatus for supporting media during advancement along a predetermined flow axis. The apparatus includes: a media guide device forming a pair of spaced media guide surfaces which extend generally along the flow axis to define an elongate channel between the pair of media guide surfaces such that advancing media is supported along a print medium edge by the pair of media guide surfaces and directed downstream along the flow axis thereby, the channel including at least one segment which extends angularly upward from the flow axis in a plane so as to establish a sheet-stiffening bend in the advancing media; and one of the pair of media guide surfaces is movable such that the advancing media is selectively released from the channel by moving the one of the pair of media guide surfaces.

In another basic aspect, the present invention includes a wet ink print media handling system for supporting media ejected through an output port of a printer along a generally horizontal output axis, the printer depositing consecutive output media sheets onto a surface that lies in a plane subjacently parallel to the axis. The system includes: at least one print media guide mechanism having an upper guide and a lower guide defining an elongate channel therebetween configured nominally to extend downstream from a first predetermined side edge of the output port for receiving a corresponding first predetermined side edge of a sheet of media ejected through the output port, the channel including an elongate first channel segment extending substantially parallel to the output axis and an elongate second channel segment turning upwardly from the first channel segment to establish a stiffening bend in the sheet of media ejected through the output port, the guide mechanism including a release mechanism for selectively retracting the lower guide such that the sheet of media is expelled from the print media guide mechanism into the surface.

In another basic aspect, the present invention provides an ink-jet hard copy apparatus. The hard copy apparatus includes: a print media input tray; an output tray having a substantially horizontal output tray floor; a printing zone located in a paper path between the input tray and the output tray; a paper transport mechanism adjacent the input tray and the output tray, for sheet feeding print media sheets sequentially from the input tray along the paper path through the printing zone to the output tray; a print media first guide mechanism, mounted superjacent the output tray, to capture a predetermined first side edge of a print media sheet output by the paper transport mechanism, the first guide mechanism having an upper guide having a lower guide surface and a lower guide having an upper guide surface wherein the lower guide surface and upper guide surface form a first channel therebetween, the first channel having an upstream segment defining a plane substantially parallel to and above the output tray floor and a downstream segment rising upwardly from the plane such that a sheet-stiffening bend is imparted to the sheet output as the sheet is ejected by the transport mechanism through the first channel; and a media release mechanism coupling the paper transport mechanism to the lower guide such that the lower guide is selectively retractable wherein the sheet is dropped by the guide mechanism toward the output tray floor.

In another basic aspect, the present invention provides a method for preventing premature contact between consecutive sheets of output print media having wet ink print thereon. The method includes the steps of: receiving a first sheet of advancing output print media having wet ink print thereon at an output stacking area having a substantially horizontal floor plane; consecutively receiving and holding in a plane above the floor plane each subsequent sheet of advancing output print media along a longitudinal edge of each the subsequent sheet; imparting an upward bend to the subsequent sheet by directing a leading edge of the sheet at an angle of ascension from the substantially horizontal plane wherein the angle is predetermined to impart a sheet-stiffening bend to the sheet such that the sheet is supported above the output stacking area by holding the longitudinal edge until a trailing edge of the subsequent sheet is received; and following receiving the trailing edge and holding the subsequent sheet for a time period sufficient for drying ink on a sheet, releasing the subsequent sheet to fall under force of gravity onto each immediately preceding sheet in the output stacking area.

It is an advantage of the present invention that it avoids smearing or blotting of ink which results from premature contact between consecutively ejected wet ink hard copy output.

It is an advantage of the present invention that it provides a compact, single sheet print media output buffer for wet ink printers, adaptable to working with any width of media.

It is an advantage of the present invention that it provides a wet ink sheet media ejection system that works in concert with gravity, allowing the media to begin moving away from the paper path as soon as an ejection cycle commences.

It is another advantage of the present invention that it provides simple and effective mechanisms for actuating media ejection systems.

Other objects, features and advantages of the present invention will become apparent upon consideration of the following explanation and the accompanying drawings, in which like reference designations represent like features throughout the drawings.

BRIEF DESCRIPTION OF THE DRAWINGS

FIGS. 10A through 10C show detail of a camming mechanism used in accordance with the present invention as shown in FIGS. 2 through 9 in which:

FIG. 10A shows the PRINT POSITION,

FIG. 10B shows the between PRINT and EJECT POSITION, and

FIG. 10C shows the EJECT POSITION.

FIGS. 11 through 11B show an alternative embodiment of the present invention in which:

FIG. 11 is a perspective view of an alternative embodiment of the present invention as shown in FIGS. 2 through 9 with the wet ink print media handling system in a PRINT POSITION, FIG. 11B is a planar top view of the embodiment of FIG. 11 and 11A.

The drawings referred to in this specification should be understood as not being drawn to scale except if specifically noted.

DESCRIPTION OF THE PREFERRED EMBODIMENT

Reference is made now in detail to a specific embodiment of the present invention, which illustrates the best mode presently contemplated by the inventors for practicing the invention. Alternative embodiments are also briefly described as applicable.

Figure 1:
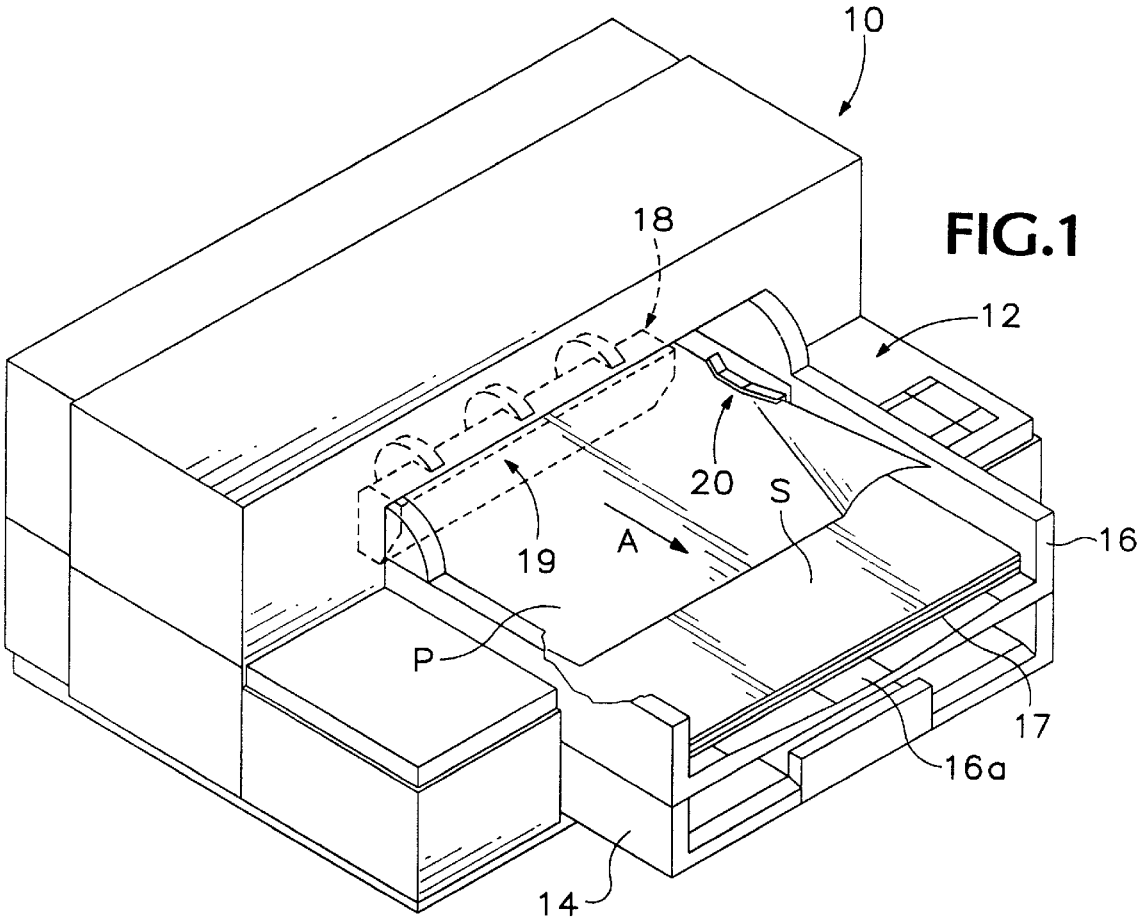
FIG. 1 is a perspective view of an exemplary sheet media ink-jet printer incorporating the present invention.

With reference to FIG. 1, an exemplary ink-jet printer 10 includes a chassis 12 having an input tray 14 and an output tray 16. The input tray 14 functions to contain and align a stack of cut-sheet print media prior to transport to an internal printing station (not shown) as would be well known in the art. The output tray 16 receives and holds a stack 17 of ejected sheets. A paper transport mechanism 18 directs the sheets along a paper path from the input tray 14 through the printing station and to an output port 19 through which they are consecutively ejected onto the output tray 16. Output is generally horizontal along media flow axis "A." The output tray 16 has a floor 16*a* generally lying in a plane parallel to the horizontal axis "A" at some vertical drop distance therebelow. As will be recognized by a person skilled in the art, some low-cost and portable hard copy apparatus merely eject the printed sheets on to a desktop or other workplace surface. The present invention is equally suited to use with such a trayless output implementation.

In accordance with the present invention, the printer 10 is provided with an output media handling system, designated generally as element 20, which temporarily supports a printed sheet "P" being ejected by the transport mechanism 18 along axis "A" above the output stack 17 for a time during which a preceding ejected printed sheet "S" atop the output stack 17 is afforded additional drying time. Once the ink on sheet "S" has been afforded this additional drying time and before the next consecutive sheet is transported out of the printing station, sheet "P" is released to fall into the output tray 16. Optimally, the release of sheet "P" will correspond with the completion of printing and output transport to avoid slowing the printer 10 throughput cycle time. The system 20 can be mounted on either side of the output tray 16 region of the printer 10, and is preferabably mounted to the side of the printer which is designed to act as the reference edge for print media loading and feeding. Note also that, a media handling system in accordance with the present invention can include mechanisms mounted on both sides of the output port 19 to guide both lateral edges of an ejected media sheet; one such embodiment will be discussed hereinafter in further detail with respect to FIG. 14, where one system is a near mirror image of the other.

Figure 2:
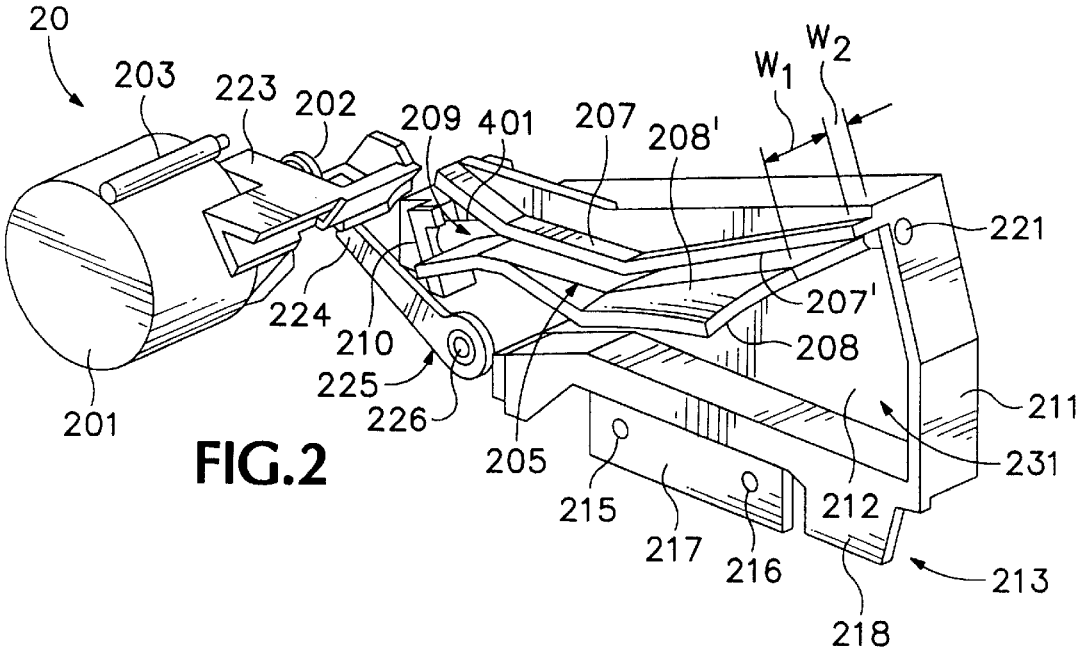
FIG. 2 is a front perspective view of the wet ink print media handling system in accordance with the present invention in a "PRINT POSITION."
Figure 3:
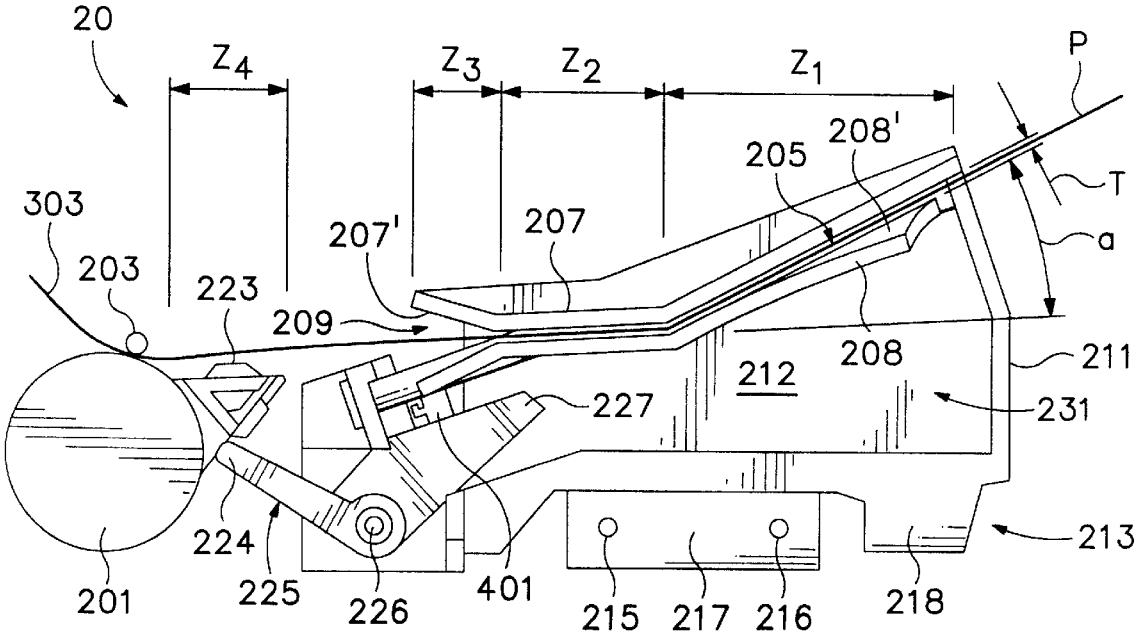
FIG. 3 is the wet ink print media handling system in accordance with the present invention as shown in FIG. 2 with an exemplary sheet of paper traversing a paper path therethrough.

Referring to FIGS. 1, 2, 3, and 4, the handling system 20, is shown with its components in the printing operation, paper feed, PRINT POSITION. The paper transport mechanism 18 incorporates a cut-sheet paper feed roller 201, mounted on a drive shaft 202 (FIGS. 2 and 4; drive motor not shown) and a pinch roller 203 which receive a leading edge of the output sheet "P" through a nip therebetween which become an active part of the system 20. FIG. 3 depicts the "PAPER PATH" by labeled arrow 301. The leading edge 303 of an output sheet "P" is directed into a elongate channel, or slot, 205 between a pair of narrowly spaced guides: an upper media guide 207 and a lower media guide 208. The channel 205 thus defines an output track for sheets as they are consecutively ejected from the printer output port 19. Sheets are not pinched between the guides 207, 208, but rather are pinched between the paper feed roller 201 and the pinch roller 203 and are captured within the channel 205 by frictional forces sufficient to support the sheet "P." Therefore, in the paper feed PRINT POSITION, the gap "T" (FIG. 3) defined by a lower surface 207' (FIGS. 2 and 3 only) of the upper media guide 207 and an upper surface 208' of the lower media guide 208 is preferably only slightly greater than the thickness of the maximum thickness of a conventional, flexible, sheet media that is compatible with the printer 10; e.g., preferably a gap "T" in the range of approximately an eight-tenths (0.8) millimeter to one-and-two-tenths (1.2) millimeters.

In accordance with the present invention, the upper media guide 207 and lower media guide 208 are independently functioning. The upper media guide 207 is fixed to, or integrally formed with, a support structure, or frame, which includes a front wall 211, a back wall 210, a substantially vertical rear side wall 212, and a lower mounting fixture 213. The lower mounting fixture 213 includes apertures 215, 216 and mounting tabs 217, 218, or other known in the art mechanisms for mounting the system 20 to the printer 10. As shown in FIG. 1, once mounted, the system 20 establishes a fixed relationship for the output ejection paper path 301 relative to the output tray 16.

As shown in FIG. 3, the channel 205 has a lead-in zone, "$Z_1$." The leading edge 303 of an advancing output sheet will pass from the printing zone "$Z_4$" of the printer to a media guide inlet 209 defined by a lead-in zone $Z_1$ divergence of the upper and lower guides 207, 208, typically at an included angle of approximately forty-five degrees. The paper leading edge 303 proceeds to be guided into the gap "T" between the upper surface 208' and lower surface 207' of the respective guides 208, 207.

In the paper path 301 direction of travel, the channel 205 next provides a downstream travel flat zone, "$Z_2$" between the upper media guide 207 and lower media guide 208 in a plane generally aligned to the print zone "$Z_4$" and in or substantially parallel to axis "A." The flat zone "$Z_2$" of the channel 205 is followed by a downstream upwardly angled sheet exit zone "$Z_3$." The upward bend angle as shown in FIG. 3 has an angle "a" in the range of approximately five (5) to twenty-five (25) degrees from the plane of flat zone "$Z_2$." It should be noted that the flat zone "$Z_2$" may be considered optional; that is, the entrance zone "$Z_1$" can be followed immediately by the exit zone "$Z_3$" for some in another implementation. The channel segment flat zone "$Z_2$" has a preferable length in the range of approximately zero (0) to fifteen (15) millimeters; the channel segment exit zone "$Z_3$" has a preferable length in the range of fifteen (15) to twenty-five (25) millimeters.

Figure 15:
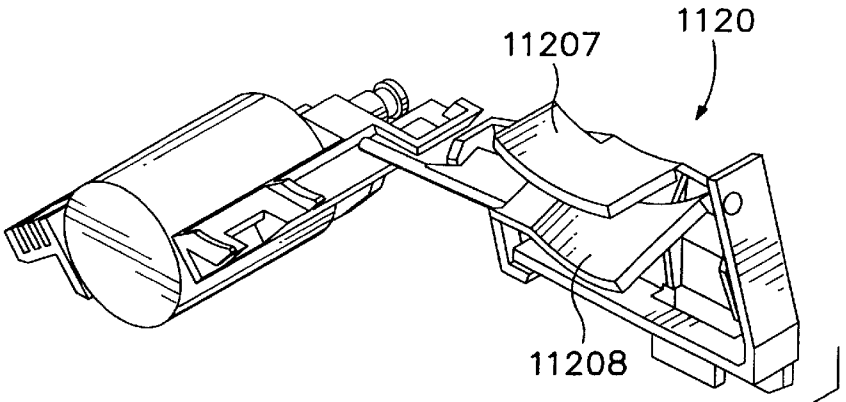
FIG. 15 is a detail drawing of a lower media guide element of the present invention as depicted in FIGS. 1 through 4.
Figure 15:
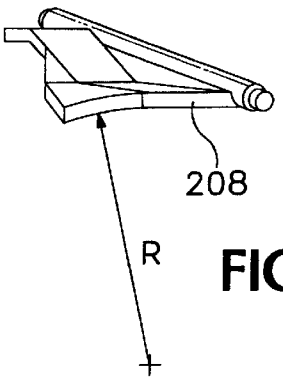

The channel 205 has a depth, perpendicularly oriented with respect to axis "A," along the plane of the paper path 301 defined by the rear wall 212 in conjunction with the lower surface 207' of the upper media guide 207 and the upper surface 208' of the lower media guide 208. The channel depth is designed to capture a lateral edge of the ejected sheet between the surfaces 207', 208' such that the paper edge will not catch or bind with the inner most surface of the channel 205 and simultaneously, the upper guide 207 does not extend overly into the plane of the ejected sheet where it could potentially smear any wet ink between the margins of the printed sheet. The lower media guide upper surface 208' has a downstream flare region such that the width "$W_1$" (FIG. 2 only) at the outer extremity of the system 20 is greater than the generally constant width "$W_2$" of the upper media guide 207, wherein $W_2$ is also the initial upstream channel depth. In the preferred embodiment, the upper media guide 207 has a cross-channel width dimension in the range of approximately three (3.0) to five (5.0) millimeters; 3.4 millimeters being the cle facto industry standard for the minimum margin. Thus, the lower media guide 208 has an added width provided by the flare region which increases support for the ejecting sheet "P," while allowing a narrow upper media guide that will not smear ink adjacent the margin of the printed output sheet. The inward extension of the lower media guide 208 further helps to maintain media sheet "P" shape as it is ejected from the transport mechanism 18. Without the added support, ejected sheet media "P" tends to sag toward its longitudinal center axis and pull out of the channel 205. This flared section begins in the flat zone "$Z_2$" and continues through the exit zone "$Z_3$," as needed in any specific design implementation. As best seen in FIG. 2, the lower media guide 208 is also provided with an inward declination, or curvature, region along the paper path 301 direction, generally in-board of the channel 205 between the lower surface 207' and the upper surface 208'. If declined at an angle, the angle of declination should be in the range of approximately five degrees (5°) to fifteen degrees (15°). In the preferred embodiment, it has been found advantageous to use a convex curved upper surface 208', tangential to the plane of the sheet "P" in the paper path 301 and having, as shown in FIG. 15, a radius of curvature "R" in the range of fifty (50) to one-hundred (100) millimeters. The shape of the in-board extension of lower media guide 208 is designed to complement the shape that the media naturally takes as it is angled upwardly in exit zone "$Z_3$."

Figure 4:
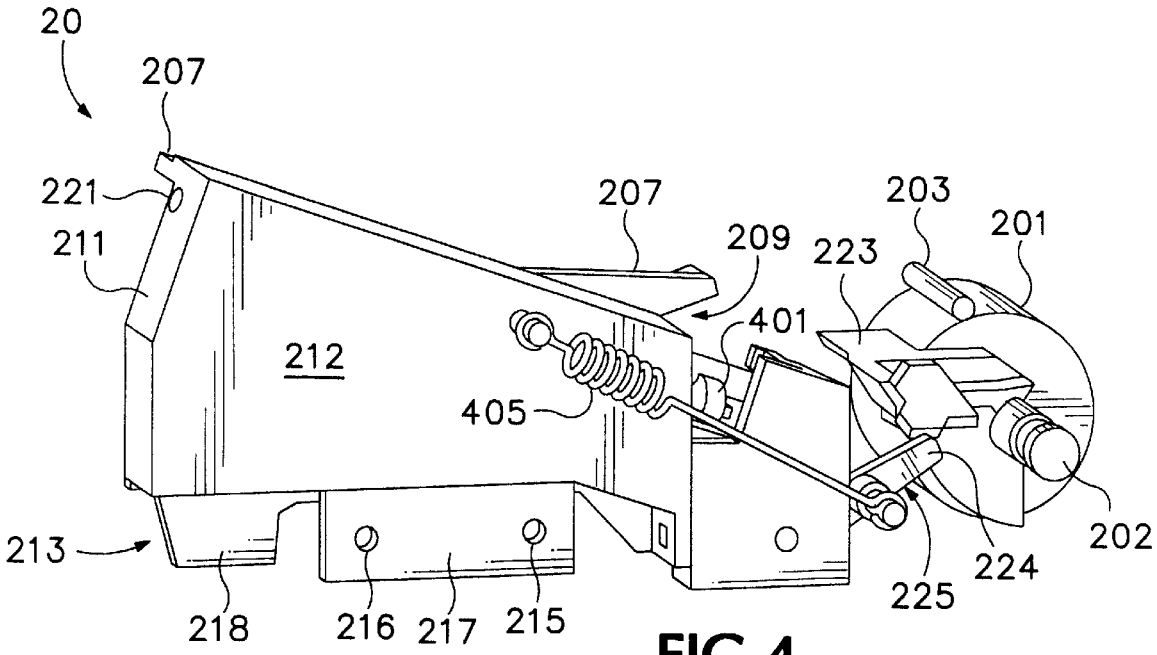
FIG. 4 is a rear perspective view of the wet ink print media handling system in accordance with the present invention as shown in FIGS. 2 and 3.

The lower media guide 208 is a separate piece part mounted to pivot about a rotational pivot axis. The pivot axis is substantially immediately out-board of the paper path 301 and generally parallel to the composite or average direction of the paper path as the paper moves through zones $Z_1$–$Z_3$. As best seen in FIGS. 2 and 4, the lower media guide 208 is mounted to the mechanism's frame front wall 211 and back wall 210 (FIG. 2) by simple pins 221 (one shown) which rotate as journals through bearing apertures in the walls 211, 210 located at each end of the lower media guide.

Note that as seen in FIG. 3, the channel 205 causes deflections of the media so that a sheet advancing along the paper path 301 is provided with a sheet-stiffening bend along the media longitudinal axis through the channel with the leading edge 303 being directed to be higher than the trailing edge 304. In operation, the overall sheet bending defines a complex geometric shape, having the main bend somewhat diagonally oriented, with the channel side bending upwardly while the opposite side remains somewhat horizontally straight forming the complex geometric shape that causes the stiffening sufficient to maintain the sheet in the system 20. The system 20 is configured to begin this longitudinal bending of an advancing ejected sheet "P" (FIG. 1) at a distance from the printer's output port 19 in order to stiffen the advancing sheet without transmitting forces from the sheet-stiffening bend back into the printing zone "$Z_4$" which would have a detrimental effect on printhead-to-media distance which in turn would affect print quality. The distance from the downstream extremity of the print zone "$Z_4$" to the entrance of the flat zone "$Z_3$" should thus be minimized for the range of deflection angles set forth hereinbefore without inducing this feedback.

Figure 5:
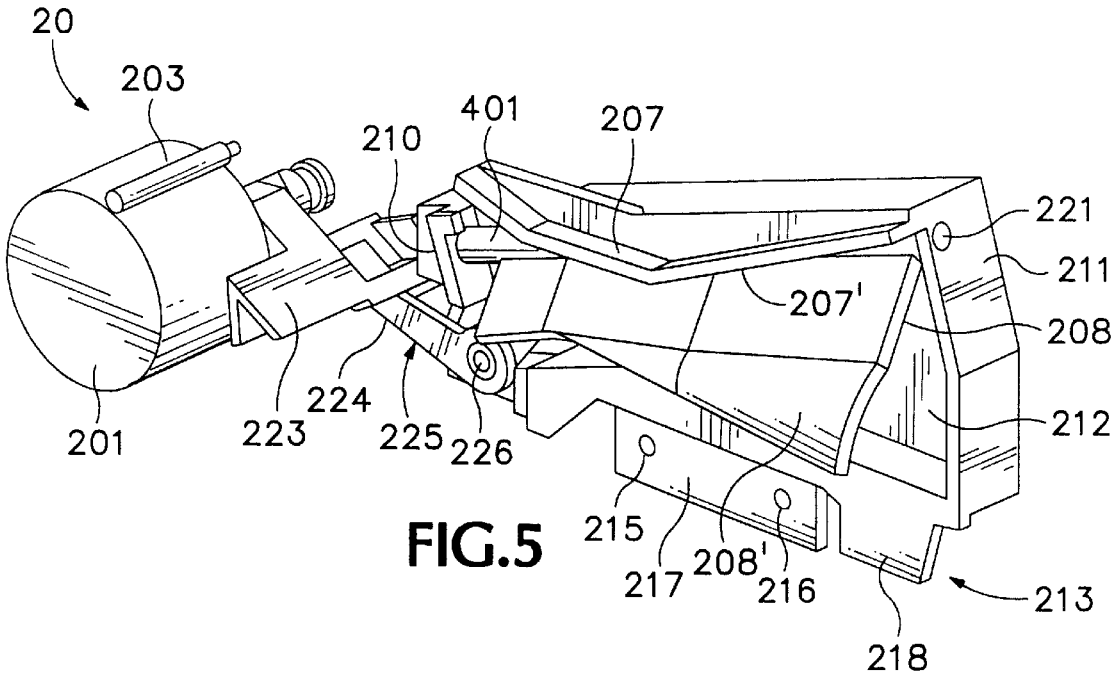
FIG. 5 is a front perspective view of the wet ink print media handling system in accordance with the present invention as shown in FIG. 2 but in a position between the PRINT POSITION and a full "EJECT POSITION."
Figure 6:
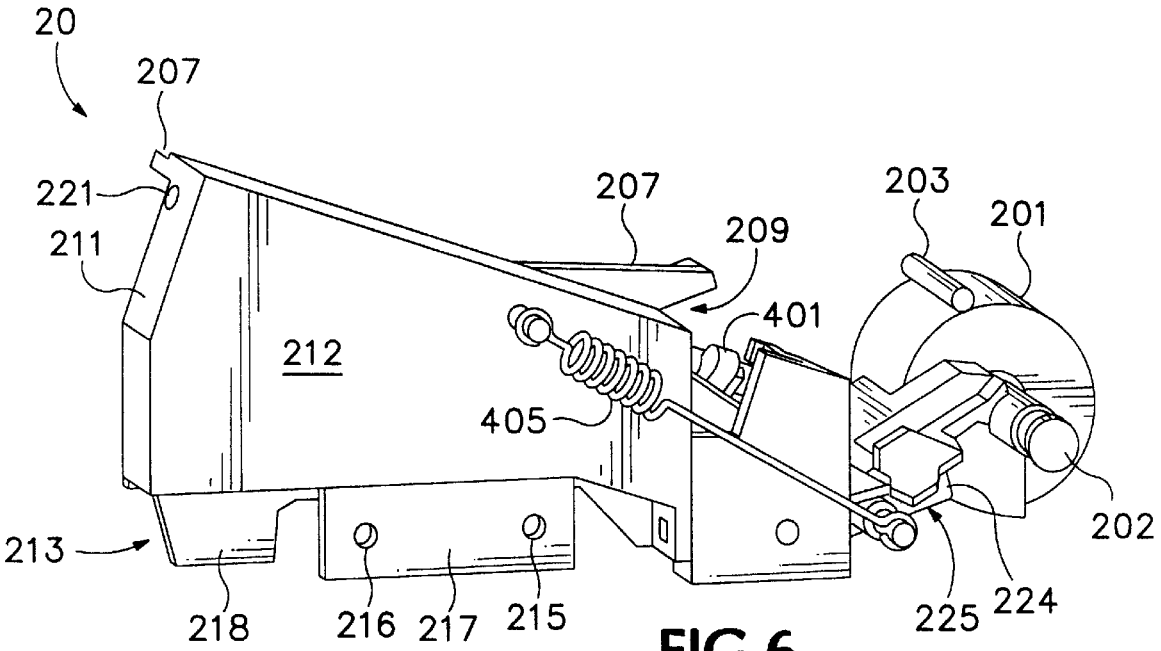
FIG. 6 is a rear perspective view of the wet ink print media handling system in accordance with the present invention as shown in FIG. 5.
Figure 7:
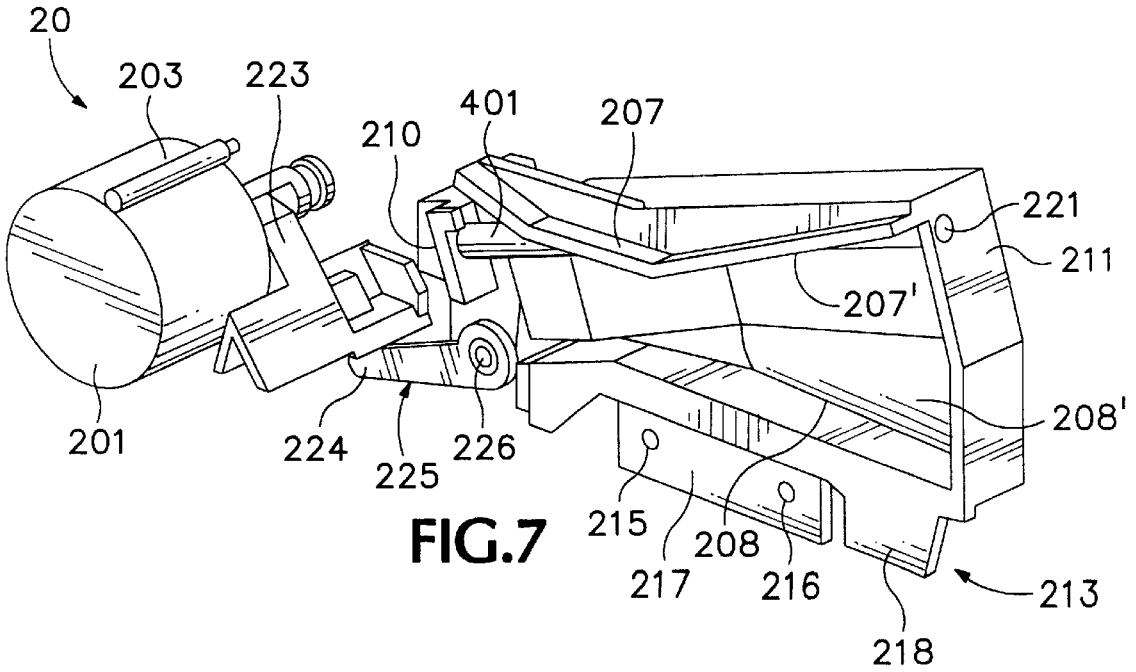
FIG. 7 is a front perspective view of the wet ink print media handling system in accordance with the present invention as shown in FIGS. 2 and 5 but in the full EJECT POSITION.
Figure 8:
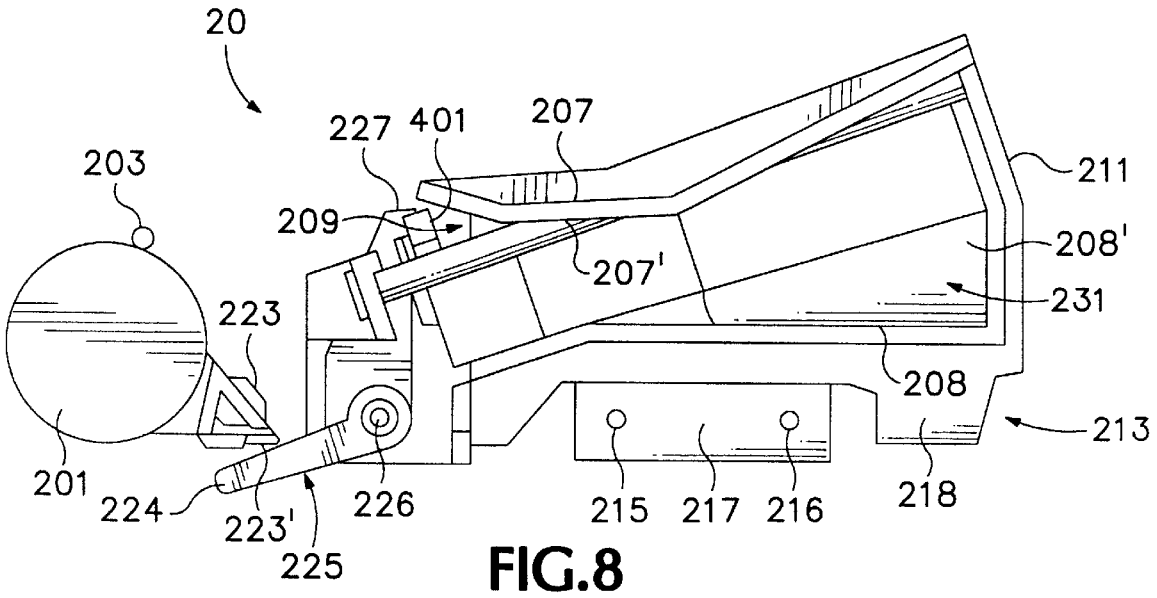
FIG. 8 is the wet ink print media handling system in accordance with the present invention as shown in FIG. 3 but in the full EJECT POSITION as shown in FIG. 7.
Figure 9:
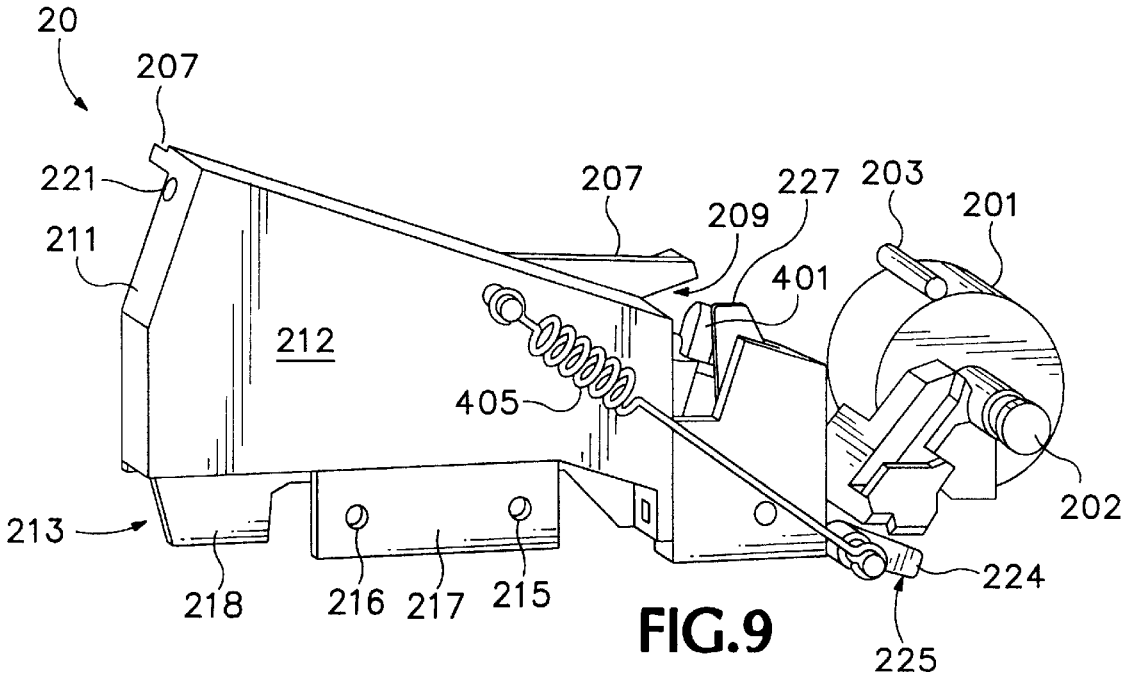
FIG. 9 is a rear perspective view of the wet ink print media handling system in accordance with the present invention as shown in FIG. 8.
Figure 10A:
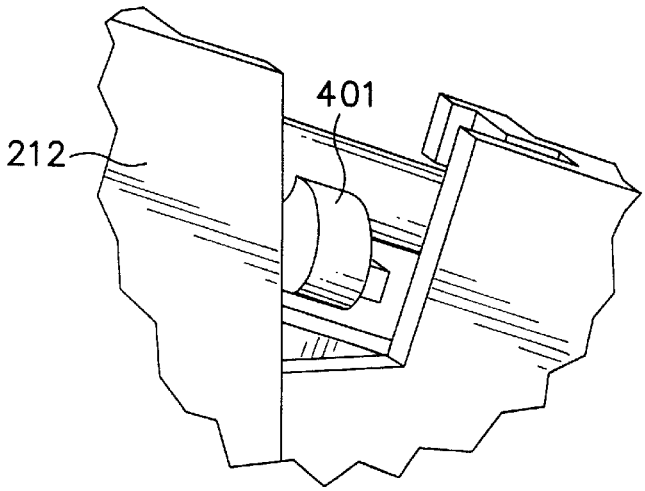
Figure 10B:
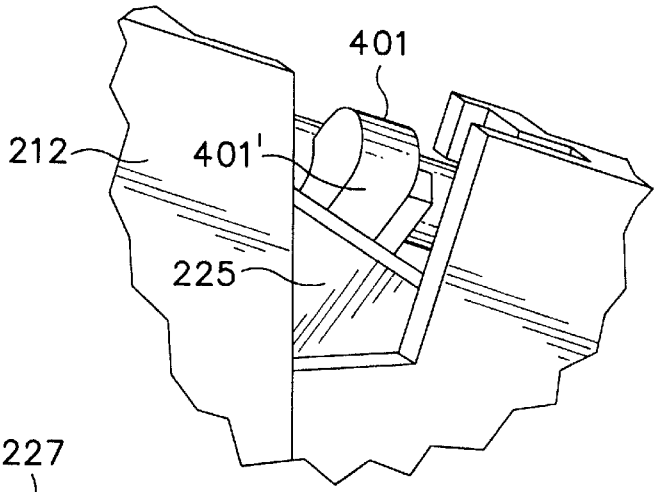
Figure 10C:
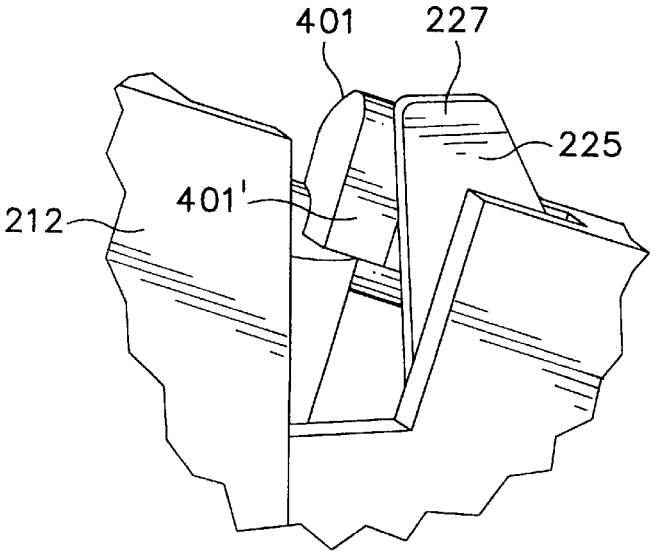

As shown in FIGS. 2 through 9, a pivot mechanism 223 for lower media guide 208 position control is connected to a drive motor (not shown) and associated with a drive cam 401 on the lower media guide 208 by a lever 225. As shown in FIG. 4, the lever 225 is biased by a spring 405 toward the PRINT POSITION of FIGS. 2–4. The timing and motion of the pivotally mounted lower media guide 208 is controlled by the printer electronics as would be known in the art. In the shown embodiment the lever spring 405 pulls the lever 225 against a stop such that in the PRINT POSITION the distal end 227 of the lever does not touch the cam 401 of the lower media guide 208. Without interference from the lever 225, the lower media guide 208 is biased at one of the pivots to stop in the PRINT POSITION, shown in FIGS. 2 through 4 such as by a simple torsion spring, or other suitable bias mechanism as would be known in the art. The bias force is chosen to hold the lower media guide 208 tightly against such a stop as sheet media passes through the channel 205. The force should be selected to maintain the PRINT POSITION for the most stiff media compatible with the printer 10 design. In the preferred embodiment for media up to two hundred (200) gram/meter$^2$ weight (110# index) use, it has been found that a torque in the range of two hundred (200) gram-meter to five hundred (500) gram-meter will pass media sheets through the channel 205 without rotating the lower media guide 208 downwardly, yet will rotate in the event of a media jam in order to prevent damage to the mechanism and to facilitate paper jam clearing. While not shown, it is possible to provide an adjustable stop mechanism for the lower media guide 208 which could also be used to vary the width and height of the channel 205. Returning to FIG. 3 and referring also to FIGS. 5 through 9, after completion of printing, the trailing edge 304 of the paper "P" travels through the nip between the feed roller 201 and the pinch roller 203. At this time, the printer controller lowers the pivot mechanism 223. As the pivot mechanism 223 is lowered, a bottom camming surface 223' (FIG. 8) presses against a proximate extremity 224 of the lever 225, rotating the lever about the lever pivot 226 and extending the spring 405 (FIG. 5). A distal extremity 227 of the lever 225 presses against the cam 401 on the lower media guide 208, rotating the guide against its bias. A mid-rotation position of the lower media guide 208 is depicted in FIGS. 5 and 6. As the rotation continues, the lower media guide 208 approaches a full rotation of approximately ninety degrees (90°), folding into a cavity 231 formed by the rear side wall 212, front wall 211, back wall 210, and lower mounting fixture 213 of the frame as depicted in FIGS. 7 and 8. As best seen in FIGS. 4 and 10A–10C detail with respect to the vertical wall 212 as shown in FIG. 4, the lever 225 slides onto a flat 401' of the cam 401 of the lower media guide 208. The purpose of the flat 401' is to complete the rotational drop of the lower media guide 208 before the pivot 223 is fully rotated given reasonable tolerances on the final rotation angle of the pivot. FIG. 10A shows the camming action and corresponds to the PRINT POSITION of FIGS. 2–4 and FIG. 10B corresponds to the BETWEEN PRINT AND EJECT POSITIONS of FIGS. 5 and 6. Beyond this rotation, as depicted in FIG. 10C, the lower media guide 208 is fully lowered into the sheet EJECT POSITION as shown in FIGS. 7 and 8.

With the lower media guide 208 fully rotated downwardly, the unsupported media sheet "P" is free to fall into the output tray 16 onto media stack "S" (FIG. 1). The pivot 223 is rotated back to the PRINT POSITION as shown in FIGS. 2–4 and the lever 225 and lower media guide 208 follow. Note that the height of the system 20 must be such that the media sheets fall a distance such that the lower media guide 208 will always clear the top of the stack "S" when containing its maximum capacity, e.g., fifty sheets, as it rotates back up toward the PRINT POSITION to receive the next consecutive printed sheet from the transport mechanism 18.

Figure 11:
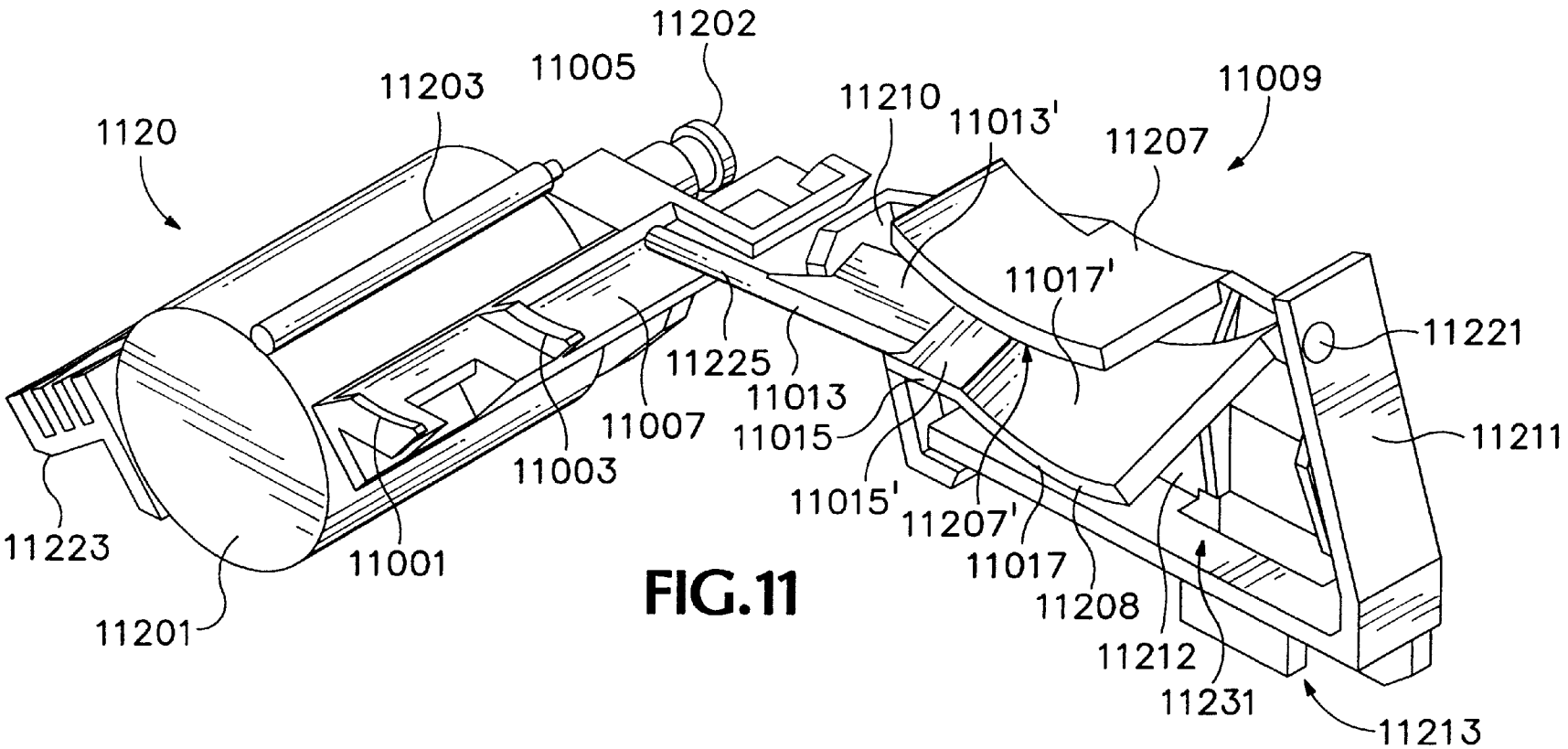
Figure 11A:
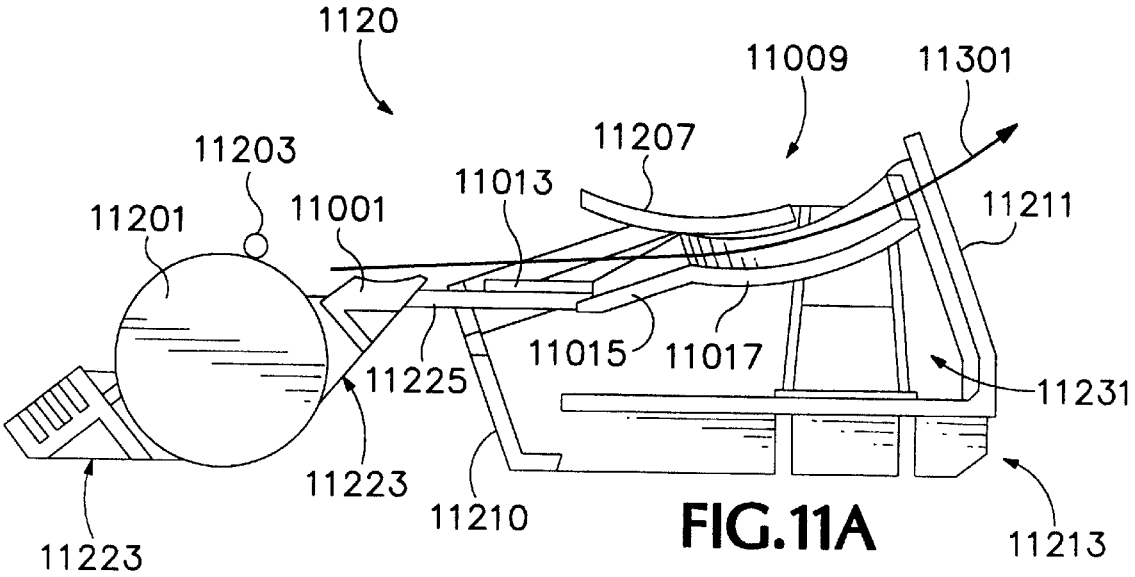
FIG. 11A is an elevation view of the embodiment of FIG. 11.

Turning now to FIGS. 11, and 11A, an alternative embodiment of the wet ink media handling system 1120 is depicted. In this embodiment, the media guides and lower media guide positioning mechanism are simplified over the camming mechanism as shown in FIGS. 2–10. Different upper and lower guide constructs are also demonstrated.

A sheet of media "P" (FIG. 1), ejected from the printer 10 output port 19 by a paper feed roller 11201 and pinch roller

11203, passes over a media guide pivot 11223. A downstream paper path section of the guide pivot 11223 includes a plurality of paper supports 11001, 11003, 11005 upon which a lateral edge margin of the advancing sheet of paper "P" will ride as it is ejected.

Figure 11B:
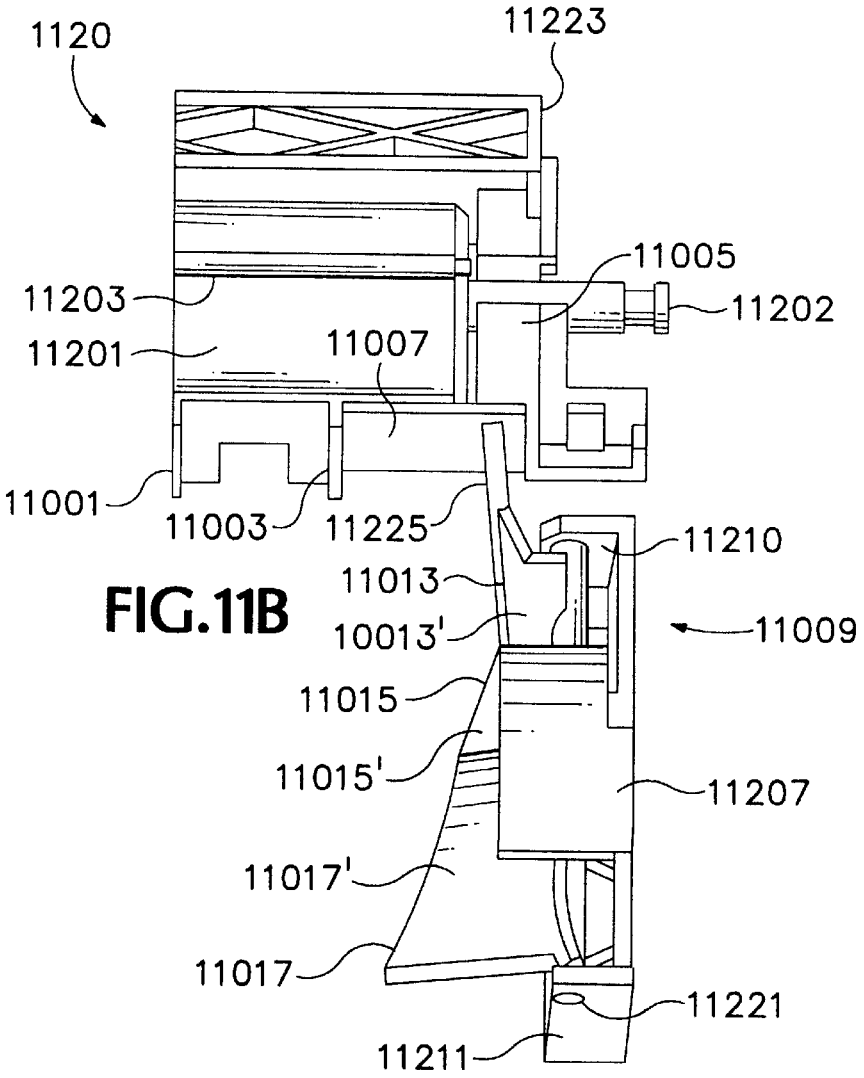

The media guide mechanism 11009 again includes an upstream back wall 11210, a downstream front wall 11211, a substantially vertical rear wall 11212, and a lower mounting fixture 11213, each being similar to the previously described embodiment. The lower media guide 11208 is mounted to the back wall 11210 and front wall 11211 of the media guide mechanism 11009 to freely rotate on mounting pins 11221 (only one of two visible in view, viz. Journaled through front wall 11211). No biasing mechanism is required for the lower media guide 11208 of the shown embodiment. The lower media guide 11208 is allowed to fall into a guide mechanism cavity 11231 under the influence of gravity alone. In other words, if unsupported, the lower media guide 11208 falls out of the way into a frame cavity 11231 formed by the back wall 11210, downstream front wall 11211, and rear wall 11212, allowing any paper being supported by the guide mechanism 11009 to drop into the output tray 16 (FIG. 1). The lower media guide 11208 is provided with a support pin 11225 on its upstream extremity. The support pin 11225 interfaces with a depressed, upper surface 11007 of the media guide pivot 11223, provided for acting as a camming surface to support the lower media guide 11208 in the PRINT POSITION as shown in FIGS. 11–11B or drop the lower media guide to the EJECT POSITION as demonstrated by FIG. 12. The pin 11225 has a diameter less than the depth of the depression in the guide pivot 11223. Therefore, an advancing output sheet "P" supported by the guide pivot paper supports 11001, 11003, 11005 also passes over the pin 11225 without interference.

A lower media guide shelf 11013, attached along the paper path outboard of the pin 11225, has a substantially flat upper surface 11013' that is generally in the media ejection plane of horizontal axis "A" (FIG. 1) at some predetermined vertical drop distance above the output tray floor 16*a* which is dependent on the designed output tray stacking capacity and clearance needed for the motion of the lower media guide 11208. Adjacently downstream of the shelf 11013 is a lower media guide incline 11015, having an upwardly directed flat surface 11015' ascending from the plane of the horizontal axis "A". The lower media guide incline 11015 imparts a first upward deflection of the ejecting media sheet "P" as its leading edge contacts the upper surface 11015' The upper media guide 11207 has its downstream extremity located above the upstream extremity of the shelf 11013 and the incline 11015 such that the combination forms a diverging lead-in zone for receiving the leading edge of the advancing output sheet therebetween. Next, adjacently downstream of the incline 11015, the lower media guide 11208 has an arcuately shaped, concave, lower media guide exit ramp 11017. It has been found that providing the lower media guide exit ramp 11017 upper surface 11017' with a radius of curvature in the range of approximately twenty-five (25) to seventy-five (75) millimeters imparts a preferred longitudinal bend to the advancing output sheet, stiffening it appropriately so that it is fully supported by a single edge captured in the channel 11205 until it is in position to drop into the output tray 16 (FIG. 1). The upper media guide 11207 also is provided with a generally arcuate shape of the same curvature such that its lower surface 11207' is parallel to the lower guide upper surface 11208'. A generally upwardly directed concave shape of the upper media guide 11207 is such that an advancing sheet "P" tangentially passes below a lower surface 11207' of the upper media guide at its upstream extremity.

Figure 12:
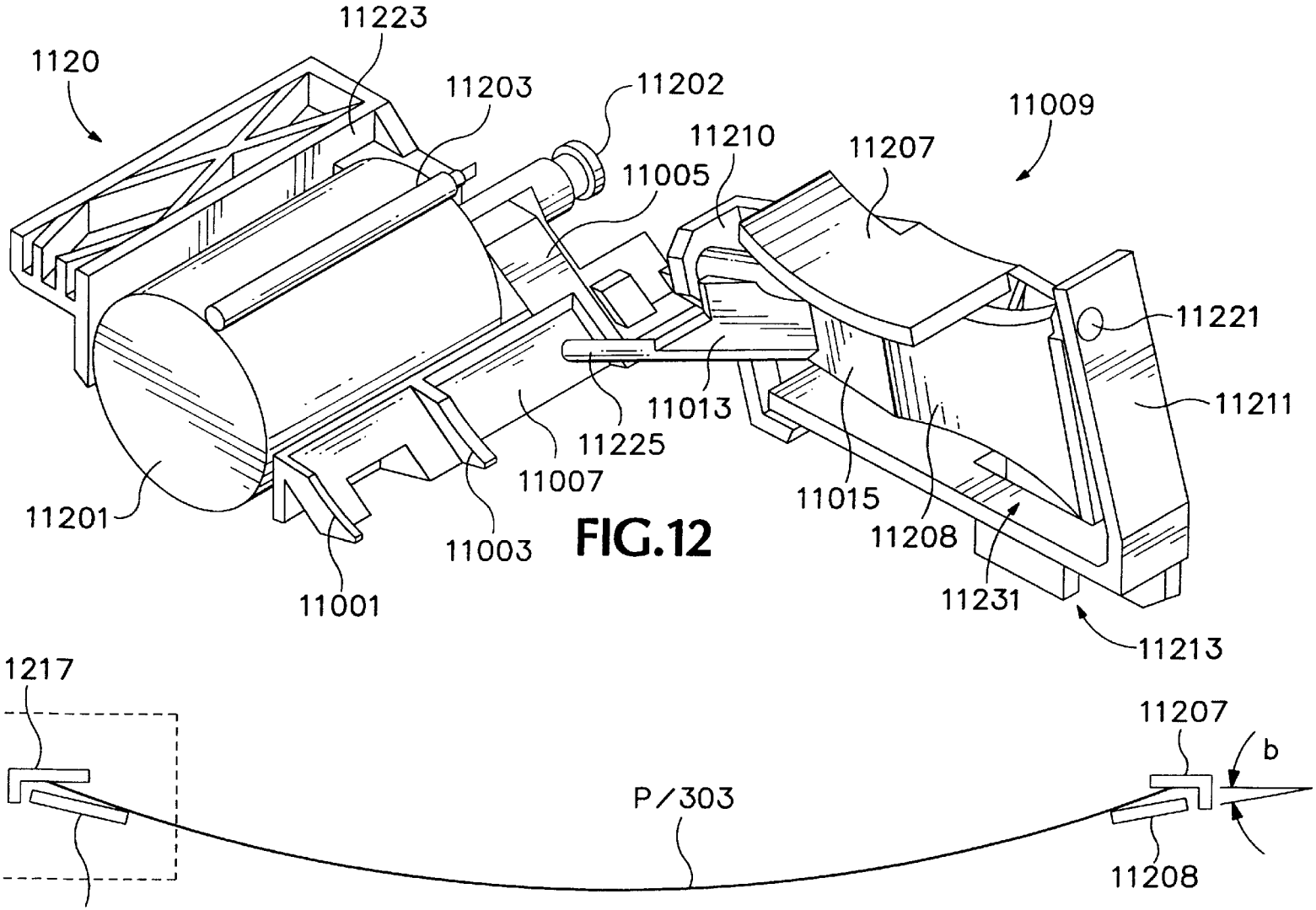
FIG. 12 is a perspective view in accordance with the present invention as shown in FIG. 11 in the EJECT POSITION.

FIG. 11A indicates the general paper path, arrow 11301, through the system 1120 between the upper media guide 11207 and the lower media guide 11208 with respect to the generally horizontal paper flow axis "A" as shown in FIG. 1 at an appropriate vertical drop distance above the output tray floor 16*a*. As in the previous embodiment, the height of the guide mechanism 11009 above the output tray floor 16*a* is dictated by the need for the returning lower guide 11208 to clear the top of the stack of media sheets in the output tray 16 when it is filled to its maximum design capacity, e.g., the height of fifty sheets. In operation, when the trailing edge 11304 passes downstream of the nip of a roller 11201 and pinch roller 11203, the guide pivot 11223 is dropped as shown in FIG. 12. The pin 11225, no longer supported by surface 11007, and the attached lower media guide 11208 is allowed to fall to the EJECT POSITION under the combined influence of the weight of the ejected sheet and gravity, falling into cavity 11231 and out of the way of the previously supported sheet "P." Thus, the sheet is free to fall into the output tray 16. After an appropriate wait time, such as when the leading edge of the next sheet to be ejected approaches the roller 11201 or received in the nip of the rollers 11201, 11203, the guide pivot 11223 is rotated back to the position shown in FIGS. 11 and 11A, lifting the pin 11225 and attached lower media guide 11208 back to the PRINT POSITION.

Note that if more force is required either for smooth operation or to speed the retraction of the lower media guide 11208, a bias can be added appropriately as would be known in the art to augment movement of the lower media guide into the cavity 11231.

Note also that in another implementation, the action can be reversed by biasing the lower media guide into the PRINT POSITION as in the embodiment of FIGS. 2 through 9 and having a surface of the guide pivot 11223 push down on the pin 11225 against the bias force.

Figure 13:
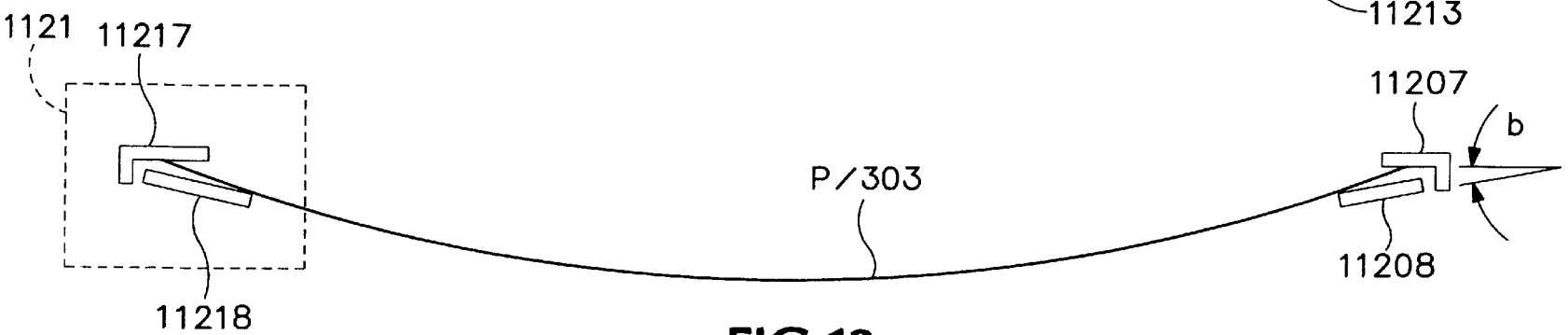
FIG. 13 is a schematic representation of a sheet of paper supported by the wet ink print media handling system as shown in FIGS. 11–11A and 12.
Figure 14:
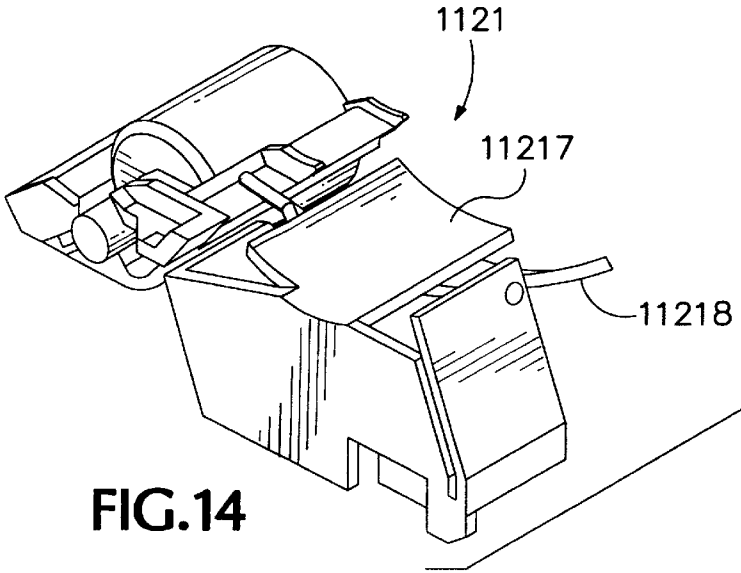
FIG. 14 is perspective view in accordance with the present invention as shown in FIGS. 11–11A and 12 for a system for supporting ejected wet ink print media along both edges of the print media in the PRINT POSITION.

Referring to FIG. 13, it is specifically intended that media guides can be installed on both sides of the paper path. The left side wet ink media handling system 1121 is generally a mirror construct of the right side system 1120 of FIGS. 11, 11A and 12 as shown in FIG. 14. For some implementations, it is also possible to use a simple, short, fixed guide for the left side. However, such a cost efficient construct may be less reliable, e.g., leaving the left side hung up after the right side system has dropped. Note again that sizing of the upper media guide on the right side is such that it does not overlap the printed output (printed side up). However, to support use of both U.S. "A-size" and metric "A4-size" requires that there be overlap on the printed output when printing on A-size media. Therefore, the guides 1120 and 1121 are constructed to have an appropriate gap so that, as shown in FIG. 13, the media sags away from the upper media guide and only the outer edge of the sheet tends to touch the lower surface of the upper media guide 11207. No smearing of ink has been detected in tests of the apparatus constructed accordingly. It has been found that an angle of declination for the lower guide from the outboard extremity of the channel toward the plane of the output tray floor in the range of five (5) to twenty (20) degrees, depicted as angle "b," is preferable. Having both side guide mechanisms active ensures that even in the event of failure of one lower guide retracting, release of a held sheet is still implemented when the opposing lower guide is retracted.

Note also that at least one of the pair of guides is sized such that media having a smaller cross-dimension than A4-size is sufficiently support by a single guide.

Moreover, note that in operation it is not necessary to support the first sheet printed. That is, the initial position of the lower media guide 208, 11208 for a new print job can be in the retracted, or dropped, position. The first sheet merely falls into the output tray 16 as it is ejected, there being no need for concern of smearing ink on a preceding sheet until the second sheet is printed.

The present invention thus avoids smearing or blotting of ink which results from premature contact between consecutively ejected wet ink sheets from a hard copy apparatus by supporting sequentially output sheets for a time period sufficient to allow drying of a previously ejected sheet before dropping a succeeding sheet on top of it. The time period required is predetermined and dependent upon the formulation of inks, paper, and the like as would be known to a person skilled in the art. In the main, the shortest time period should correspond to the longest dry time for the specific implementation.

The foregoing description of the preferred embodiment of the present invention has been presented for purposes of illustration and description. It is not intended to be exhaustive or to limit the invention to the precise form or to exemplary embodiments disclosed. Obviously, many modifications and variations will be apparent to practitioners skilled in this art. Similarly, any process steps described might be interchangeable with other steps in order to achieve the same result. The embodiment was chosen and described in order to best explain the principles of the invention and its best mode practical application, thereby to enable others skilled in the art to understand the invention for various embodiments and with various modifications as are suited to the particular use or implementation contemplated. It is intended that the scope of the invention be defined by the claims appended hereto and their equivalents.

What is claim is:

1. A print media handling apparatus for supporting media during advancement along a predetermined flow axis, comprising:

a media guide device forming a pair of spaced media guide surfaces which extend generally along the flow axis to define an elongate channel between the pair of media guide surfaces such that advancing media is supported along a print medium edge by the pair of media guide surfaces and directed downstream along the flow axis thereby, the channel including at least one segment which extends angularly upward from the flow axis in a plane so as to establish a sheet-stiffening bend in the advancing media; and one of the pair of media guide surfaces is movable such that the advancing media is selectively released from the channel by moving the one of the pair of media guide surfaces.

2. The apparatus as set forth in claim 1, the media guide device comprising:

a fixed upper guide member and a movable lower guide member such that selective movement of the lower guide member releases the advancing media from the pair of media guide surfaces.

3. The apparatus as set forth in claim 1, comprising:

the channel including a first segment which extends in a first plane substantially in the flow axis and the at least one segment which extends angularly upward from the flow axis in a plane so as to establish a sheet-stiffening bend in the advancing media is a second segment downstream of the first segment.

4. The apparatus as set forth in claim 3, comprising:

the second segment extends downstream from the first segment at an angle which is within a range of between approximately five degrees and twenty-five degrees from the first plane.

5. The apparatus as set forth in claim 3, comprising:

the first segment is in a substantially horizontal plane.

6. The apparatus as set forth in claim 1, the media guide device comprising:

includes a fixed upper guide member and a retractable lower guide member having a predetermined orientation, shape and dimensions such that selective retraction of the lower guide releases the advancing media wherein the media is released from the media guide device under force of gravity alone.

7. The apparatus as set forth in claim 6, comprising:

the upper guide member having a first cross-channel width dimension; and the lower guide member having a first segment having an initial upstream second cross-channel dimension approximately equal to or greater than the first cross-channel width dimension and, downstream of the first segment, a second segment having an increasing second cross-channel width dimension.

8. The apparatus as set forth in claim 7, comprising:

the lower guide member having an upper surface forming a substantially triangular flaring region over a downstream region of the first segment and continuing through the second segment such that an outer extremity of the lower guide upper surface is wider than the second cross-channel dimension.

9. The apparatus as set forth in claim 8, comprising:

the flaring region lies in a third plane which declines inwardly from the second plane.

10. The apparatus as set forth in claim 8, comprising:

the flaring region has a cross-sectional convex curved top surface, having a tangential intersect with a plane of the flow axis of the advancing media.

11. The apparatus as set forth in claim 10, comprising:

the convex curved top surface has a radius of curvature in the range of fifty to one-hundred millimeters (50 to 100 mm).

12. A wet ink print media handling system for supporting media ejected through an output port of a printer along a generally horizontal output axis, the printer depositing consecutive output media sheets onto a surface that lies in a plane subjacently parallel to the axis, the system comprising:

at least one print media guide mechanism having an upper guide and a lower guide defining an elongate channel therebetween configured nominally to extend downstream from a first predetermined side edge of the output port for receiving a corresponding first predetermined side edge of a sheet of media ejected through the output port, the channel including an elongate first channel segment extending substantially parallel to the output axis and an elongate second channel segment turning upwardly from the first channel segment to establish a stiffening bend in the sheet of media ejected through the output port, and the guide mechanism including a release mechanism for selectively retracting the lower guide such that the sheet of media is expelled from the print media guide mechanism into the surface.

13. The system as set forth in claim 12, further comprising:

a paper feed roller mounted on a drive shaft;

the guide mechanism including a guide pivot means for selectively controlling movement of the lower guide mounted adjacently to the paper feed roller;

a frame for mounting the upper guide arid the lower guide to the printer superjacently of the surface and downstream of the paper feed roller such that the channel is at least partially in a plane of the axis, the upper guide being fixed mounted to the frame, and the lower guide being moveably mounted to the frame.

14. The system as set forth in claim 13, comprising:

the release mechanism including means for coupling the guide pivot means to the lower guide such that the guide pivot means selectively controls movement of the lower guide toward and from the plane.

15. The system as set forth in claim 14, comprising:

means for biasing the lower guide toward a first position for forming the channel; and the release mechanism providing a force for moving the lower guide against the means for biasing to a second position substantially orthogonal to the plane such that the sheet of media falls to the surface.

16. The system as set forth in claim 14, comprising:

the release mechanism has a first position for providing a force for holding the lower guide in a first position for forming the channel; and the release mechanism is selectively moveable to a second position such that the lower guide drops under force of gravity alone such that the sheet of media falls to the surface.

17. The system as set forth in claim 13, comprising:

the lower guide being rotatably mounted to the frame at an angle declining from an outboard region of the channel toward the plane of the surface when the lower guide is supporting a sheet of the media ejected through the output port.

18. The system as set forth in claim 12, further comprising:

a second print media guide mechanism configured for defining an elongate channel to extend downstream from a second predetermined side edge of the output port opposite from the first predetermined side edge of the output port and for receiving an opposite corresponding predetermined side edge of the sheet of media ejected through the output port such that the sheet of media is supported along both lateral edges thereof.

19. The system as set forth in claim 12, comprising:

the lower guide having an upper surface having at least one region defining an upwardly directed segment of the channel at a downstream extremity thereof such that an upwardly directed sheet-stiffening bend is imparted to the sheet of media along the axis.

20. The system as set forth in claim 19, comprising:

the upper guide having a lower surface having at least one region defining an upwardly directed segment of the channel at a downstream extremity thereof such that an upwardly directed sheet-stiffening bend is imparted to the sheet of media along the axis and such that the channel has a substantially constant height dimension between the lower surface and the upper surface.

21. The system as set forth in claim 12, comprising:

a third elongate channel segment located downstream of the second elongate channel segment, the third elongate channel segment having a generally arcuate shape for imparting an upwardly curved bend to the sheet of media.

22. The system as set forth in claim 21, comprising:

the third channel segment having the upwardly curved bend having a radius of curvature in the range of approximately twenty-five to seventy-five millimeters (25–75 mm).

23. An ink-jet hard copy apparatus comprising:

a print media input tray;

an output tray having a substantially horizontal output tray floor;

a printing zone located in a paper path between the input tray and the output tray;

a paper transport mechanism adjacent the input tray and the output tray, for sheet feeding print media sheets sequentially from the input tray along the paper path through the printing zone to the output tray;

a print media first guide mechanism, mounted superjacent the output tray, to capture a predetermined first side edge of a print media sheet output by the paper transport mechanism, the first guide mechanism having an upper guide having a lower guide surface and a lower guide having an upper guide surface wherein the lower guide surface and upper guide surface form a first channel therebetween, the first channel having an upstream segment defining a plane substantially parallel to and above the output tray floor and a downstream segment rising upwardly from the plane such that a sheet-stiffening bend is imparted to the sheet output as the sheet is ejected by the transport mechanism through the first channel; and a media release mechanism coupling the paper transport mechanism to the lower guide such that the lower guide is selectively retractable wherein the sheet is dropped by the guide mechanism toward the output tray floor.

24. The apparatus as set forth in claim 23, the first guide mechanism further comprising:

a third segment having a lead-in zone divergence forming an expanded channel inlet positioned for receiving a leading edge of the advancing media from the transport mechanism.

25. The apparatus as set forth in claim 23, comprising:

a print media second guide mechanism, mounted superjacent the output tray, to capture a predetermined second side edge of a print media sheet output by the paper transport mechanism, the second guide mechanism having an upper guide having a lower guide surface and a lower guide having an upper guide surface wherein the lower guide surface and upper guide surface form a second channel therebetween.

26. The apparatus as set forth in claim 25, comprising:

the second channel having an upstream segment defining a plane substantially parallel to and above the output tray floor and a downstream segment rising upwardly from the plane such that a sheet-stiffening bend is imparted to a sheet output as the sheet is ejected by the transport mechanism through the second channel; and a media release mechanism coupling the paper transport mechanism to the lower guide such that the lower guide is selectively retractable wherein the sheet is dropped by the second guide mechanism toward the output tray floor.

27. A method for preventing premature contact between consecutive sheets of output print media having wet ink print thereon, comprising the steps of:

receiving a first sheet of advancing output print media having wet ink print thereon at an output stacking area having a substantially horizontal floor plane;

consecutively receiving and holding in a plane above the floor plane each subsequent sheet of advancing output print media along a longitudinal edge of each the subsequent sheet by receiving each subsequent sheet of advancing output print media along both longitudinal edges of each the subsequent sheet;

imparting an upward bend to the subsequent sheet by directing a leading edge of the sheet at an angle of ascension from the substantially horizontal plane wherein the angle is predetermined to impart a sheet-stiffening bend to the sheet such that the sheet is supported above the output stacking area by holding the longitudinal edge until a trailing edge of the subsequent sheet is received; and following receiving the trailing edge and holding the subsequent sheet for a time period sufficient for drying ink on a sheet, releasing the subsequent sheet to fall under force of gravity onto each immediately preceding sheet in the output stacking area.

28. The method as set forth in claim 27, further comprising the steps of:

imparting a cross-sectional sag to the advancing output print media sheet such that wet ink thereon does not contact any mechanism during the time period.

29. The method as set forth in claim 27, wherein the step of receiving and holding comprises the step of:

receiving and holding an advancing output print media sheet along at least one edge thereof between a pair of surfaces having a gap therebetween such that frictional forces imparted to the edge are sufficient to retain the sheet therein without contacting wet ink regions on the sheet.

30. An edge support device for advancing cut-sheet wet print media, comprising:

an upper media guide, having an upper guide leading edge for receiving a leading edge of the advancing cut-sheet print media below the upper guide leading edge, and a lower surface having an upwardly directed curved profile extending from the upper guide leading edge to a paper path downstream trailing edge;

a lower media guide having a lower guide leading edge for receiving a leading edge of the advancing cut-sheet print media above the lower guide leading edge and an upper surface having an upwardly curved profile extending from the lower guide leading edge to the paper path downstream trailing edge;

the lower surface and the upper surface forming a substantially constant height channel therebetween for receiving a longitudinal edge of the advancing cut-sheet print media, the channel imparting a sheet-stiffening bend to the advancing cut-sheet print media such that the advancing cut-sheet print media is supported against gravity due to the bend.

31. The device as set forth in claim 30, further comprising:

the upper media guide has a cross-channel dimension such that the lower surface does not touch wet print on the advancing cut-sheet print media.

* * * * *